US005165722A

United States Patent [19]

Wong

[11] Patent Number: 5,165,722

[45] Date of Patent: Nov. 24, 1992

[54] BOOK LEAF HOLDER

[76] Inventor: Harold L. Wong, 742 Francisco Blvd. West, San Rafael, Calif. 94901

[21] Appl. No.: 834,825

[22] Filed: Feb. 13, 1992

[51] Int. Cl.[5] ..... B42D 9/00

[52] U.S. Cl. ..... 281/442; 281/45; 24/67.9

[58] Field of Search ..... 281/42, 45, 15.1, 51; 24/336, 67.9, 67 R, 67.3

[56] References Cited

U.S. PATENT DOCUMENTS

| | | | |
|---|---|---|---|
| 464,512 | 12/1891 | Moffitt | 281/42 |
| 472,571 | 4/1892 | Ferguson | 281/42 |
| 2,565,966 | 8/1951 | Jaffin | 281/42 |
| 4,382,617 | 5/1983 | Fortier | 281/42 |
| 4,474,383 | 10/1984 | Kikis | 281/42 X |

*Primary Examiner*—Timothy V. Eley
*Assistant Examiner*—Willmon Fridie, Jr.
*Attorney, Agent, or Firm*—Thomas M. Freiburger

[57] ABSTRACT

A book leaf holder maintains a book in an opened position with the pages held firmly down. In a preferred form the holder comprises a single piece of wire having a curving back portion and bends at each end forming arms which extend over the opened pages and a clip-like end which maintains the arms in position. The wire device acts somewhat in the manner of a large paper clip, having an undeformed position which is essentially planar and tending to return to the planar condition when in use, tending to urge the book toward being flat. The center curving section of the device bears against the center binding behind the opened book, and in the usual manner of use the arm on each side clips over and holds down an opened page. The end finger or clip beyond the arm is inserted under a sheaf of pages, e.g. 30 or 50 pages below the opened page. The book holder clip stores flatly and is useful as a bookmark when the book is closed. Other embodiments, formed of other materials and of multiple components, are disclosed.

7 Claims, 4 Drawing Sheets

BOOK LEAF HOLDER

BACKGROUND OF THE INVENTION

The invention is concerned with devices for holding books in opened configuration, particularly paperbacks but also including hard cover books. More specifically, the invention relates to a book leaf holder which has an essentially planar configuration, which conveniently holds a book to an open position for one-handed reading by the user, and which is useful as a bookmark when the book is closed.

Numerous different configurations of book leaf holders have been disclosed. For example, see U.S. Pat. Nos. 4,932,680, 4,645,236, 4,474,383, 4,382,617, 4,235,457, 3,513,806, 2,271,807 and 1,469,163. The book holding devices of most of these patents are designed to function from the center of the book, engaging in some way with the book's binding and having a member which spreads the leaves from the center outward. Kemp U.S. Pat. No. 4,645,236 shows a book page holder formed from a thin, flat single piece of material such as acrylic plastic, with a pair of fork-like fingers at each end. The device is to be used by inserting it in a clip-like manner in engagement with the leaves of the open book, at the top or bottom of the book, with each pair of fingers acting as a clip. The page holder generally straddles the center binding. No member extends behind the book, i.e. around the front and rear covers and the binding, and the pages are held from positions near the center binding. The device disclosed in the patent would not seem to strongly urge the book toward the intended open position, particularly in the case of books having a strong tendency to close, such as paperbacks.

Kikis U.S. Pat. No. 4,474,383 is in some respects closer to the concept of the present invention, in disclosing a book leaf holder device comprising an elongated back member and a page clip at each end of the back member. The back member extends behind the book when in open position, i.e. behind the book's front and back covers, and a clip at each side is engaged over a sheaf of pages. The device is formed of two pieces, foldable together about a central pivot point for storage when not in use. The described book leaf holder is formed of members having a band-like cross section so that a fairly wide area of engagement occurs against the pages at the clips, covering text. Accordingly, the book holder is disclosed as being transparent. There is no capability of storing the Kikis book holder in planar or near planar configuration, thus precluding storing the book holder in the book itself.

Although the prior art is replete with book leaf holders in hundreds of configurations, none of these has the features and advantages of the present invention described below.

SUMMARY OF THE INVENTION

The book leaf holder of this invention enables the book to be held open at a position desired by the reader thus enabling the book to be held in one hand. In a preferred embodiment the book leaf holder is formed of an elongated and flexible piece of material having a flexible and springy characteristic so as to permit bending while tending to return to its original position.

A central or back member of the elongated piece of material extends behind the book binding and the front and rear covers of the open book, i.e. horizontally across the back of the book. This central member is of sufficient length to extend from the edge of the front cover to the edge of the back cover when the book is in the opened configuration. At each end of the central member, preferably integrally formed with the central member, is a clip-like structure for clipping book leaves. Each clip has a first page-engaging arm or finger positioned to be capable of engaging against the surface of an opened page when the central member is in a springing, stressed configuration behind and against the outer surface of the binding of the book.

In cooperation with the first arm or finger, on each clip-like structure at the ends of the device, is an attached means for acting together with the first arm to hold the arm tightly against the book page.

In preferred embodiments the means cooperating with the first arm is a second arm or finger positioned to be springingly engaged under a sheaf of leaves of which the opened page is the first leaf. In effect the two arms or fingers at each end act in the manner of a paper clip for holding the page-engaging arm in its intended position and for coacting with the entire elongated device in the manner of a generally planar clip which attempts to return to the planar configuration when slightly deformed in the book-engaging position.

Preferably the elongated piece of material comprises an integral metal wire such as spring wire, although other forms of wires or filaments or flat strips of elastically deformable material may be used, such as some plastics. The device may comprise an integral metal wire, but coated in portions or in its entirety with a plastic coating similar to that used on some paper clips for better gripping of the book leaves.

The gripping arms or fingers at the ends of the book leaf holder may be formed with a series of acute-angle bends in the wire or filament, forming generally an "M" shape at each end of the wire. For better insertion between pages in a stack of book leaves at each side of the opened book, the extremities of the wire may be formed into a curve or small loop, so that the roundness of the wire's cross section facilitates easy slipping of the wire between the leaves.

The invention encompasses additional embodiments, including some embodiments formed of multiple components. Common features of all embodiments are the presence of a central or back member which extends across the front and back cover of the book, with some form of clip attached to or extending from each end of the back member, for gripping the open leaf of the book not only to clip the leaves together at the edge of the book but also to anchor the ends of the back member so that the back member can act as a spring tending to pull the book toward a flattened, fully-opened position. Another common feature is the flatness of the book leaf holder (or an ability to be easily flattened), enabling flat storage when not in use.

In the most preferred form of the invention, the integral wire book leaf holder with the acute-angled bends at each end is used, at each end, with the first arm or finger over and against an open page, and the second arm or finger extending between leaves far below the page which is opened. The ends thus act as double acting paper clips, clipping a sheaf of pages below the opened page and also clipping between the opened page and the cover of the book. The entire device can be considered analogous to a pair of paper clips rigidly attached to a wire which acts as a springing flexure member. However, it differs from the Kikis patent referenced above, in that the flexure member does not use flexure bias solely in the direction which clearly tends to spread the book open. Instead the wire is actually being flexed in two directions at once—a flexure direction which is within the plane of the undeformed book holder device, flexed in this direction when the device is first spread open to place it on the opened book; and a near-perpendicular direction, in flexure which occurs when the end clips are put into place, the central or back member into forced engagement with the binder at the back of the book and bending the back member to curve somewhat out of the plane of the undeformed device.

It is therefore among the objects of the present invention to provide a book leaf holder which is simple and convenient to use, reliable, economical to produce, easily used, storable in a flat configuration and useful as a bookmark when the book is closed. These and other objects, advantages, and features of the invention will be apparent from the following description of a preferred embodiment, considered along with the accompanying drawings.

DESCRIPTION OF THE DRAWINGS

FIGS. 2A through 2J are a series of perspective, somewhat schematic views showing manner of use of the book page holder clip of the invention.

DESCRIPTION OF PREFERRED EMBODIMENTS

Figure 1:
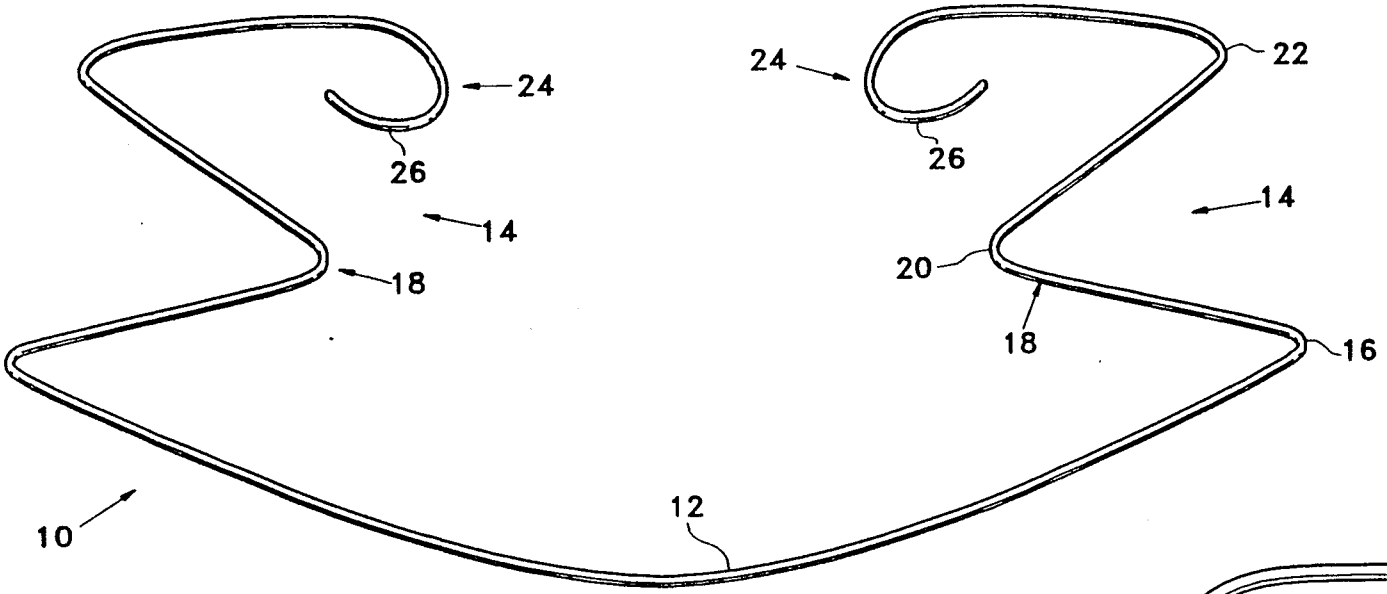
FIG. 1 is a plan view showing a book leaf holder according to a preferred embodiment of the invention, shown in an essentially planar configuration.

In the drawings, FIG. 1 shows a book leaf holder 10 in the preferred form of an integral wire of elastically deformable material such as metal wire. It may comprise, as an example, grade 18-190NS spec W-106A spring wire. The wire clip has a central or back member 12 which acts as a spine or brace when the device is in use. The back member 12 preferably is somewhat curved as shown. In preferred embodiments the wire lies essentially in a single plane.

At each end of the back member 12 is an end clip structure generally identified as 14, with each end clip structure 14 advantageously formed, as shown, by a series of bends in the wire. At a first acute-angle bend 16, the wire turns inwardly to form a first arm or finger 18 which has an inward point 20 where the wire bends acutely outwardly as shown. Another acute-angled bend or tight curve 22 then defines the other end of the arm 18, and an end portion 24 of the wire defines a second arm or finger, preferably having a curve or loop 26 at its extremity. Thus, each end clip structure 14 defines generally, along with the central or back member 12, an "M" shape or "W" shape as can be seen in FIG. 1.

Figure 1A:
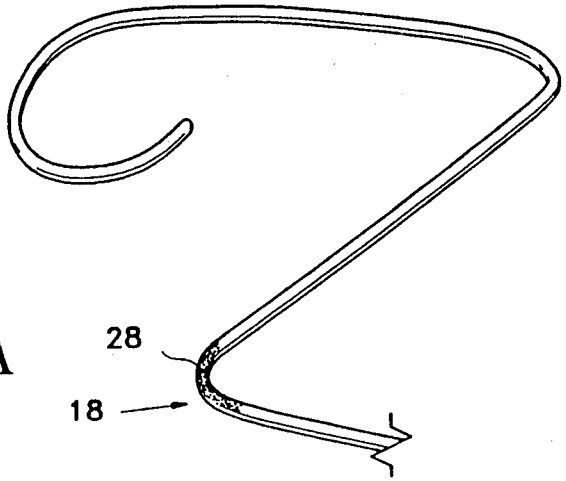
FIG. 1A is a detail view showing one side of the book leaf holder and indicating a feature included on preferred embodiments.

FIG. 1A shows a preferred feature which may be included on the wire book leaf holder 10. The tip or apex of the arm of finger 18 may be roughened as at 28, at both upper and lower surfaces, to better grip the page surface. AS an alternative this area or the entire book leaf holder can be coated with a rubbery or vinyl sleeve such as present on some paper clips, for the same purpose.

FIGS. 2A through 2I demonstrate ways in which the book leaf holder clip of the invention may be inserted onto a book 30 and used to hold the book leaves in open position as desired.

Figure 2C:
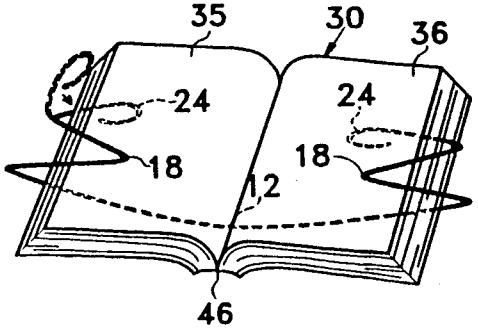
Figure 2F:
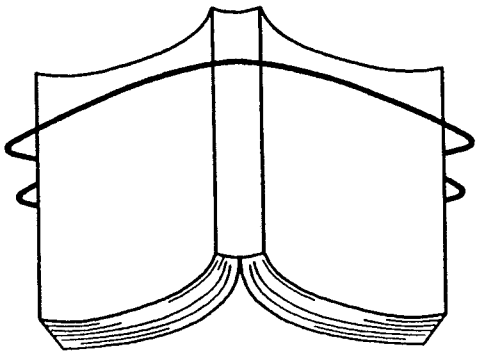
Figure 2B:
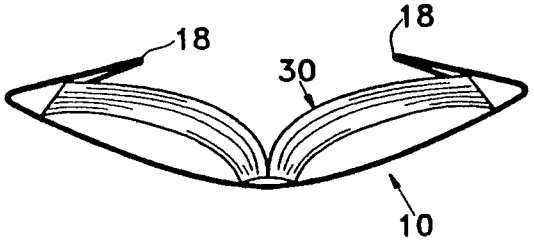
Figure 2E:
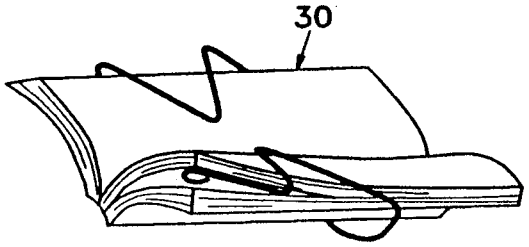
Figure 2A:
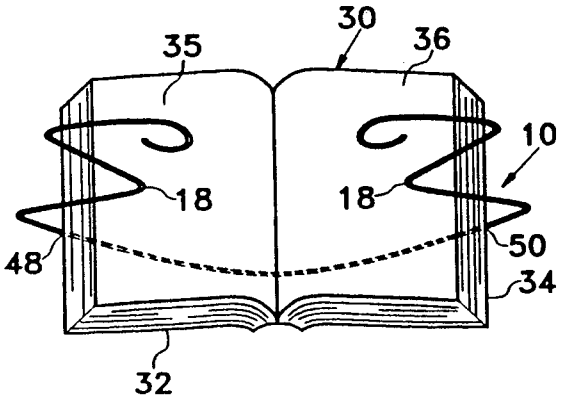

Steps for securing the book leaf holder device 10 to the book 30 are seen by reference to FIGS. 2A through 2F. These show the steps for engaging the book in the normal manner. FIG. 2A shows that the leaf holder 10 is first spread open, within its own plane, to enable the first arms or fingers 18 to clear the extremities of the front cover 32 and rear cover 34 of the book. These fingers 18 are then engaged over leaves 35 and 36 of the opened book. This preliminary position is shown both in FIG. 2A and in FIG. 2B, and end view.

Figure 2D:
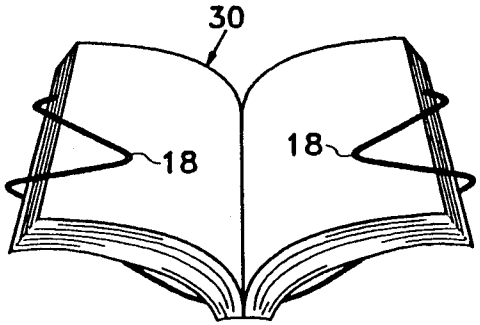

FIG. 2C shows the next step for using the book leaf holder in the normal position. By this step the ends of the wire or second arms or fingers 24 are inserted under a sheaf of pages at each side. FIGS. 2D and 2E show this same position of engagement, from other angles. In this way, as discussed above, the book leaf holder acts something similar to a large double acting paper clip. Its central or back member 12 is deflected out of the normal planar configuration, tending to hold the book toward the open, flattened configuration. The first arms 18 clip, at each side of the book, all of the pages and the cover between this arm and the back member 12. In addition, a sheaf of pages is clipped between the first arm 18 and the second arm or finger 24. A type of three point engagement is made at each edge of the book—the holder engages against the outer surface of the cover, against the opened book leaf and against the bottom of the sheaf of pages, via the second arm or finger 24. The result of this three point engagement at each end of the leaf holder is that the entire leaf holder is deflected out of its normal planar configuration and, by tending to flex back toward the planar configuration, the leaf holder tightly grips the sheaves of pages and tends to hold the book toward a flattened configuration. The primary principles of operation of the book leaf holder 10 are that it clips sheaves of leaves on each side of the book; and it always tends to bias toward its original planar configuration.

Figure 2I:
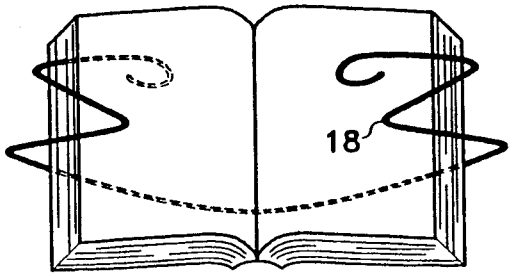
Figure 2H:
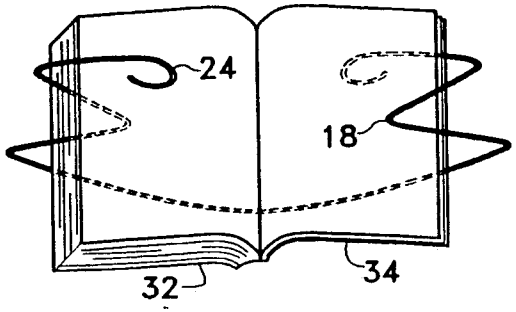
Figure 2G:
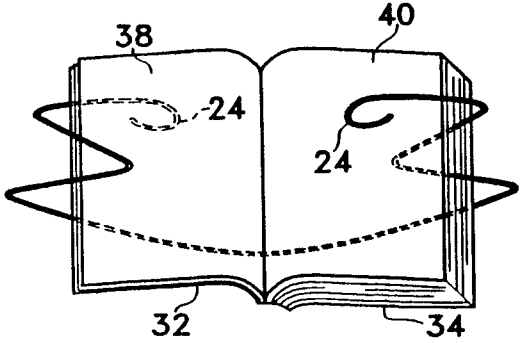

FIGS. 2G through 2I show other ways of using the book leaf clip 10. As shown in FIGS. 2G and 2H, when the book 30 is opened to a position near its beginning (or its end) the leaf holder device may be used in a different way from the manner in which it is used deeper into the book. The first arm 18 on the left side of the device lies over the few leaves 38 on the left side, but the second arm or finger 24 will be placed under the front cover 32, there being no significant stack of pages under which this second arm can be inserted. At the right side of the book the device is also used somewhat differently. The sheaf of pages 40 on the right comprises nearly the entire book, and the thickness of this stack of pages may be too great for the first arm to be placed over the opened page and the second arm inserted about 30 to 100 pages down, in the normal manner. In this situation the first arm can more easily be inserted between pages of this large stack 40 as shown in the figure, with the second finger 24 being used to engage and hold down the page of interest. In this way the very large stack of pages is adequately held, albeit somewhat more loosely, and the user is not required to bend and distort the leaf holder 10 to such a great extent as would be required if used in the normal manner shown in FIGS. 2A–2F.

FIG. 2H shows the opposite situation wherein the book is near its end.

FIG. 2I shows the left side of the leaf holder fully engaged as in FIGS. 2A–2F, but the right side only partly engaged, with the finger 18 over the opened page but the finger 24 idle. This leaf holder can be used in this way when desired.

It should be noted that in FIGS. 2G–2I the book leaf holder device 10 still acts to hold the book open through the tendency of the device 10 to return to its normal planar configuration, as discussed above. The engagement shown at the left side of the book in FIG. 2G engages that side of the device so as to tend to turn the device 10 toward a plane parallel to the pages. This is not true at the right side at the stack of pages 40 and the back cover 34, but it is sufficient that one side be anchored to engage the plane effect. It is also possible to use the right side of the device with the first arm or finger 18 lying over the pages but the second arm or finger not used at all, which is the manner of use shown in FIG. 2I.

Figure 3C:
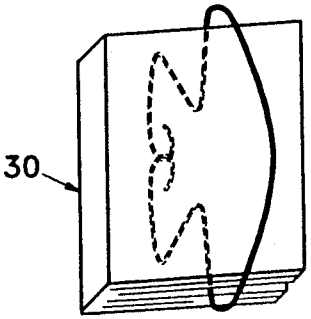
FIGS. 3A through 3C are a series of schematic views showing how the book leaf holder can be used as a bookmark when the book is closed.
Figure 3B:
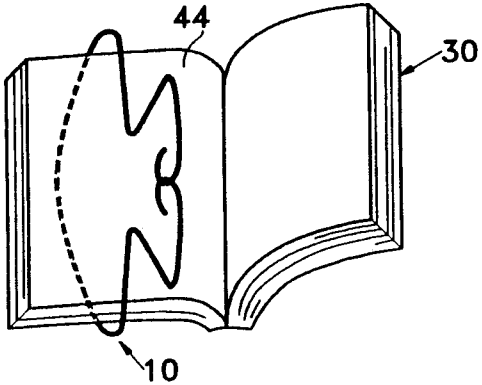
Figure 3A:
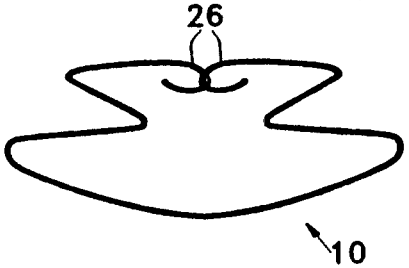

FIGS. 3A, 3B and 3C show, somewhat schematically, the manner in which the book leaf holder 10 of the invention can be used as a bookmark. The device 10 is placed over one cover and a sheaf of pages 44 with the end loops 26 hooked together, as indicated in FIGS. 3A and 3B. When the book is closed, as shown in FIG. 3C, the hooked together loops are closed inside the book, between pages, and the central or back member 12 lies closely against the outside of the book cover as illustrated. It should also be pointed out that the device 10 with the loops hooked together can be simply placed in flat planar configuration between pages of the book, with the book closed over the device and the ends of the device extending only minimally, if at all, outside the book. This is a second way in which the book leaf holder can be used as a convenient bookmark, while also providing a convenient storage for the leaf holder.

FIGS. 1, 2A and 2C provide assistance in understanding the principle of operation of the invention. The device preferably is substantially planar in its rest configuration as in FIG. 1. The central or back member 12 engages against the center binding 46 of the book, with the book opened, as in FIGS. 2A and 2C. The back member 12 also makes contact with the faces of the front and back book covers 32 and 34, at their extremities, points 48 and 50 as illustrated. The first arms or fingers 18 are engaged against open pages. Without more (as in FIG. 2A), there would be nothing but a loop engagement of the book and of the two sheaves of pages; the book would not be reliably and firmly held open and in fact the leaf holder device 10 would simply fall loosely to a position with its plane perpendicular to the plane of the opened pages, with nothing firmly engaging and clipping the device to the book.

It is the engagement of the second fingers 24 between pages, in a sheaf of pages on either side of the book, that tends to rotate the plane of the page holder 10 toward a position coincident with or parallel to the opened pages of the book, that grips the book firmly and tends to hold the book in a flattened, opened position. The clip device 10 and the book both tend toward a plane. The springing flexibility of the device 10 allows the device to elastically deform somewhat out of its normal planar configuration and to continuously exert a pressure or tension on the book while still allowing some flexibility in the handling of the book and in advancing the pages while reading. Thus, the book leaf holder acts somewhat in the manner of a large paper clip, in two different ways: in clipping the sheaves of pages at each edge of the book, together and to the adjacent cover; and on a larger scale, in acting on the entire book with the device engaged to both edges and covers and the back member pressing against the center binding of the book, due to the device's tendency to return to the planar configuration.

The principles of the invention can be realized with a book leaf holders having cross sections which are not cylindrical. A flat member can be used, but the flatness should be in the plane of the entire device, rather than being in a perpendicular direction. The flattened cross section will stiffen the device somewhat in one direction, and it will maintain the flat, low profile of the device. Thus, the book page holder could be molded of a plastic with such a flattened cross section. A disadvantage of this form of the invention is that the footprint of the page engaging arms will be larger, covering more of the text, but the plastic material can be transparent.

Figures 4, 5:
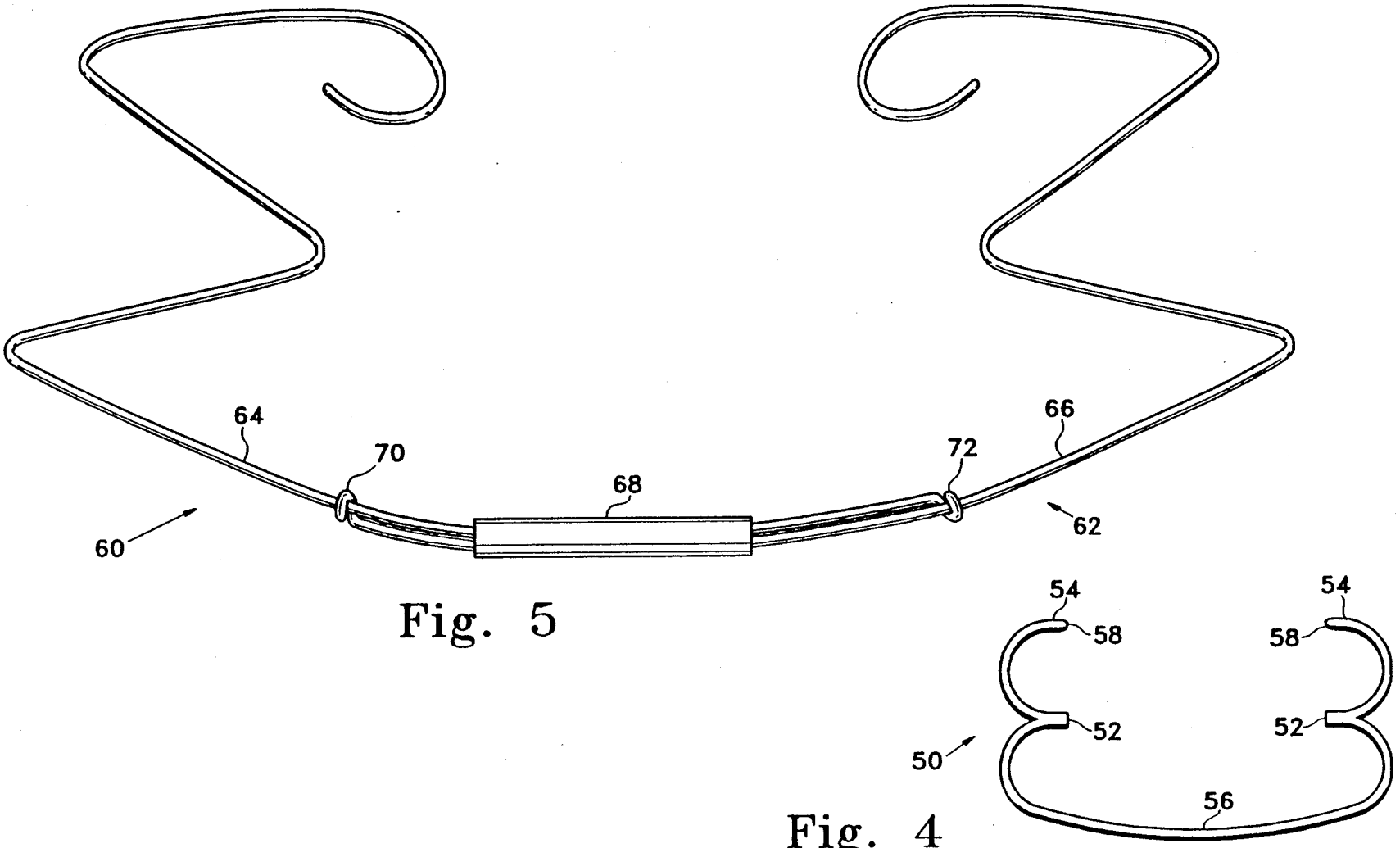
FIG. 4 is a plan view showing a different embodiment of the invention, for extension to accommodate larger and hard bound books.
FIG. 5 is a plan view showing a further embodiment of the invention.

FIG. 4 schematically indicates another possible configuration of the device of the invention, although the configuration described above is most preferred. FIG. 4 shows a book leaf holder 50 which has a different style of arms 52 and 54 from those described above. The back member 56 is similar to that of the book holder 10, extending a sufficient distance to span across the front and back cover of the book when the book is fully opened. The fingers or arms 52 are narrower in this embodiment, and in fact the device 50 is configured to be more adaptable to molding from plastic material. Provision is made at tips 58 for insertion of these tips of the fingers 54 between pages. For example, these tips can be rounded or tapered for easy insertion into a sheaf of pages.

Although the leaf holder of the invention is particularly adaptable to and convenient for use with paperback books, it can also be adapted for hardbound books which are heavier and larger. This generally requires a heavier and larger wire, if the leaf holder comprises wire, with a somewhat stiffer bending characteristic.

However, hardbound books vary widely in width, and the book leaf holder embodiment 60 shown in FIG. 5 is intended to address the size variations. The leaf holder 60 is of a non-integral construction, with a back member 62 which is formed by left and right portions of wire 64 and 66, guided for sliding movement together by a guide housing such as a tubular sleeve 68 as shown in the drawing, and with wire ends 70 and 72 each looped over the other wire for sliding.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A leaf or page holder for a book, for enabling the book to be held open at a position desired by the reader so that the reader can hold the book in one hand while reading, comprising:

an elongated and flexible formed piece of material, the material having a springy characteristic and being flexible so as to permit bending while tending to return to its original position the piece of material being formed generally in a single plane when undeformed, the elongated piece of material having a central or back member for extending behind the binding and front and rear covers of an opened book, of sufficient length to extend from the edge of the front cover to the edge of the back cover when the book is in the opened position, the piece of material having at each end of the central member, connected to the central member, a first page engaging arm configured so as to be capable of engaging against the surface of an opened page when the central member is in a springing, stressed condition behind and against the binding of the book, the two arms at the two ends of the central member both extending generally inwardly, toward each other, at each end of the page holder, connected to the first page engaging arm, there being an attached means for acting in conjunction with the first page engaging arm as a clip to hold the first page engaging arm tightly against the book page, and the leaf or page holder being normally in a generally planar configuration, with the springy characteristic tending to return the page holder to the planar configuration when deformed.

2. The device of claim 1, wherein the means for acting as a clip comprises a second arm at each end of the device, with the two second arms oriented inwardly, generally toward each other, so that each second arm can be engaged between pages, under a stack of leaves, to clip the first arms in position against the opened pages.

3. The device of claim 1, wherein the elongated piece of material comprises an integral metal wire.

4. The device of claim 1, wherein the means for acting as a clip, at each end of the device, comprises a second arm defined by a loop at the end of the piece of material, the loop facilitating insertion of the second arm between pages below the opened page so that a stack of pages are clipped between the second arm and the first arm to firmly hold the first arm down against the opened page.

5. The device of claim 1, wherein the central or back member is formed generally in a curved shape, and at each end of the back member the piece of material is formed in an acutely angled bend which is positioned to extend around the edge of the book's front or back cover, as well as around a group of pages, and the piece of material then extending in generally straight configuration to a second acutely angled bend, forming said first arm.

6. The device of claim 5, wherein the attached means for acting as a clip comprises a second arm at each end of the device, extending inwardly from the outer end of the first arm toward an opposing second arm, with means for assisting the second arm in being inserted between pages, so that a stack of book leaves can be clipped between the first and second arms to hold the first arm firmly against the opened page and to cooperate with the central or back member to elastically deform the page holder out of its normal planar configuration, further pressing the central or back member against the binding behind the book and thus further tending to stress the book toward a flattened configuration.

7. A wire clip for holding a book in opened position, comprising:

a length of wire sufficient to extend from cover to cover and across the binding of an opened book, the wire having a spring characteristic so that when deformed in use it tends to return to an undeformed configuration, the wire including a back section having a length capable of extending across the two leaves behind the open book, an end section at each end of the back section, formed by the wire having a first acutely angled bend inward, a second acutely angled bend spaced from the first bend, at which the wire turns back generally outward, and a third bend spaced outwardly from the second bend, wherein the wire again turns inward, forming a generally v-shaped arm positioned to engage against a stack of pages of the opened book, and an end on the wire spaced inwardly from the third bend and having means to facilitate insertion between pages of the stack of pages when the arm lies over and bears against the top page of the stack of pages, whereby the book holder clip wire grips a sheaf of pages at each end between the arm and the end of the wire and between the arm and the outside edge of the book, to hold the pages in position at each side, and whereby the book is held open by the springing action of the center or back section which, in cooperation with the end sections, tends to pull the book toward a flattened configuration by urging the wire clip itself toward planar configuration.

* * * * *